US009272526B2

(12) United States Patent
Ando

(10) Patent No.: US 9,272,526 B2
(45) Date of Patent: Mar. 1, 2016

(54) LIQUID EJECTING APPARATUS AND METHOD FOR PRESSURIZING AND DEPRESSURIZING

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/491,153

(22) Filed: Sep. 19, 2014

(65) Prior Publication Data

US 2015/0085033 A1 Mar. 26, 2015

(30) Foreign Application Priority Data

Sep. 20, 2013 (JP) ..... 2013-194738

(51) Int. Cl.

| | |
|---|---|
| ***B41J 2/19*** | (2006.01) |
| ***B41J 2/175*** | (2006.01) |
| ***B41J 2/18*** | (2006.01) |
| ***B41J 29/38*** | (2006.01) |

(52) U.S. Cl.

CPC .. *B41J 2/19* (2013.01); *B41J 2/175* (2013.01); *B41J 2/17596* (2013.01); *B41J 2/18* (2013.01); *B41J 29/38* (2013.01)

(58) Field of Classification Search

None

See application file for complete search history.

(56) References Cited

U.S. PATENT DOCUMENTS

| | | | | |
|---|---|---|---|---|
| 6,705,711 | B1 * | 3/2004 | Richards | 347/85 |
| 2005/0185033 | A1 * | 8/2005 | Miki | 347/84 |
| 2008/0055378 | A1 * | 3/2008 | Drury et al. | 347/92 |
| 2009/0262153 | A1 * | 10/2009 | Tamaki et al. | 347/7 |
| 2011/0298875 | A1 | 12/2011 | Kobashi et al. | |

FOREIGN PATENT DOCUMENTS

| | | | |
|---|---|---|---|
| JP | 2010-208186 | A | 9/2010 |
| JP | 2011-255538 | A | 12/2011 |

* cited by examiner

*Primary Examiner* — Bradley Thies
(74) *Attorney, Agent, or Firm* — Global IP Counselors, LLP

(57) ABSTRACT

A degassing process where gas is removed by depressurizing a liquid to be less than atmospheric pressure and a pressurizing process where the liquid is pressurized to be more than the atmospheric pressure are executed at a low cost and taking up less space. There is provided a head configured to eject a liquid from a nozzle, a supply section configured to supply the liquid to the head and including a degassing section in which the liquid supplied to the head is depressurized to be less than atmospheric pressure, and a pressurizing section in which the liquid is pressurized to be more than the atmospheric pressure, and a single pump having an action of depressurizing the degassing section and an action of pressurizing the pressurizing section.

7 Claims, 9 Drawing Sheets

LIQUID EJECTING APPARATUS AND METHOD FOR PRESSURIZING AND DEPRESSURIZING

CROSS-REFERENCE TO RELATED APPLICATIONS

This application claims priority to Japanese Patent Application No. 2013-194738 filed on Sep. 20, 2013. The entire disclosure of Japanese Patent Application No. 2013-194738 is hereby incorporated herein by reference.

BACKGROUND

1. Technical Field

The present invention relates to a liquid ejecting apparatus which ejects a liquid such as ink from nozzles of a head, in particular, to a technique where a pressurizing process where the liquid is pressurized and a depressurizing process where the liquid is depressurized are performed and to a method for pressurizing and depressurizing where a supply section which supplies the liquid to the head is pressurized and depressurized.

2. Related Art

In the prior art, a liquid ejecting apparatus, such as a printer, which ejects a liquid such as ink from nozzles of a head, is known. In such apparatuses, there are times when ejecting of the liquids is not appropriately performed due to there being bubbles in the liquid, which leads, for example, to a deterioration in the quality of printing using the liquid. Therefore, for example, a degassing process is executed in the apparatus of JP-A-2010-208186 (Patent Literature 1) by activating a depressurizing pump and depressurizing the liquid after a printing operation is completed.

In addition, since favorable ejecting of the liquid is no longer possible when bubbles, foreign matter, or the like are introduced inside the nozzles, for example, printing quality is deteriorated. Therefore, bubbles and the like are discharged from the nozzles in the apparatus of JP-A-2011-255538 (Patent Literature 2) by pressurizing ink inside an ink supply tube using a pressurizing pump (a pressurizing cleaning process).

SUMMARY

In order to perform high quality printing, it is desirable that the degassing process and the pressurizing cleaning process described above be performed. However, in order to perform these processes, it is necessary to provide a depressurizing means which depressurizes the liquid for the degassing process and a pressurizing means which pressurizes the liquid for the pressurizing cleaning process, and the depressurizing means and the pressurizing means are one of the main factors behind an increase in the size of the apparatus and an increase in costs.

An advantage of the invention is to provide a liquid ejecting apparatus and a method for pressurizing and depressurizing with which it is possible to execute a depressurizing process where a liquid is depressurized so that the pressure is less than atmospheric pressure and a pressurizing process where the liquid is pressurized so that the pressure is more than atmospheric pressure at a low cost and taking up less space.

A liquid ejecting apparatus according to an aspect of the invention is provided with a head configured to eject a liquid from a nozzle, a supply section configured to supply the liquid to the head, the supply section including a degassing section in which the liquid supplied to the head is depressurized to be less than atmospheric pressure, and a pressurizing section in which the liquid is pressurized to be more than the atmospheric pressure, and a single pump having an action of depressurizing the degassing section and an action of pressurizing the pressurizing section.

In addition, a method according to an aspect of the invention is a method for pressurizing and depressurizing a supply section that is configured to supply a liquid to a head that is configured to eject the liquid. The method includes depressurizing the liquid to be less than atmospheric pressure using negative pressure that is generated by an action of a pump and pressurizing the liquid to be more than the atmospheric pressure using positive pressure that is generated by an action of the pump.

In the aspect of the invention configured in this manner, the "action of depressurizing the degassing section" has a meaning of depressurizing the degassing section directly with the pump or via an intermediate body such as a buffer tank or a manifold. In addition, the "action of pressurizing the pressurizing section" has a meaning of pressurizing the pressurizing section directly with the same pump or via an intermediate body such as a buffer tank or a manifold. In this manner, the depressurizing process where the liquid is depressurized so that the pressure is less than the atmospheric pressure and the pressurizing process where the liquid is pressurized so that the pressure is more than atmospheric pressure are executed using the single pump in the present invention. Accordingly, it is possible to reduce the size of the apparatus by sharing the pump in the depressurizing process and the pressurizing process and it is also possible to suppress costs.

Here, there may be a configuration in which positive pressure is accumulated in a pressurizing buffer tank by pressurizing using the pump and the liquid is pressurized using the positive pressure inside the pressurizing buffer tank at an appropriate timing. In this manner, it is possible to pressurize the liquid at a necessary timing using positive pressure buffering and it is possible to favorably and stably perform the pressurizing process.

In addition, a first switching section may be provided that is configured to switch between pressurizing and stopping pressurizing of the pressurizing buffer tank using the pump, and it is possible to accurately control pressurizing of the pressurizing buffer tank according to switching control using the first switching section. Accordingly, it is possible to even more favorably perform the pressurizing process. Here, a first pressure sensor that is configured to detect pressure inside the pressurizing buffer tank may be provided in order to accurately control pressurizing of the pressurizing buffer tank in this manner.

In addition, in the same manner as for the pressurizing, there may also be a configuration for depressurizing in which negative pressure is accumulated in a depressurizing buffer tank by depressurizing using the pump and degassing is performed with regard to the liquid using the negative pressure inside the depressurizing buffer tank. In this manner, due to buffering of the negative pressure, it is not necessary to always operate the pump in order to perform the degassing process. In addition, it is possible to suppress variation in the depressurizing. Due to this, it is possible to favorably and stably perform the degassing process.

In addition, a second switching section may be provided that is configured to switch between depressurizing and stopping depressurizing of the depressurizing buffer tank using the pump, and it is possible to accurately control depressurizing of the depressurizing buffer tank according to switching control using the second switching section. Accordingly, it is possible to even more favorably perform the degassing process. Here, a second pressure sensor that is configured to detect pressure inside the depressurizing buffer tank may be provided in order to accurately control depressurizing of the depressurizing buffer tank in this manner.

In addition, there may be a configuration in which the pump, the switching section, and the pressure sensor are accommodated in an accommodating section, and it is possible for the apparatus to be more compact due to this. In addition, ease of maintenance also improves.

In addition, there may be a configuration in which a retaining section that is configured to retain the liquid is provided, the pressurizing section is further configured to pressurize the liquid inside the retaining section, and the degassing section is further configured to depressurize the liquid inside the retaining section. In addition, there may be a configuration in which a retaining body that is configured to retain the liquid and a retaining section that is configured to retain the liquid between the retaining body and the head are provided, and the pressurizing section is further configured to replenish the retaining section from the retaining body by pressurizing the retaining body.

BRIEF DESCRIPTION OF THE DRAWINGS

Referring now to the attached drawings which form a part of this original disclosure.

DETAILED DESCRIPTION OF EMBODIMENTS

First Embodiment

Figure 1:
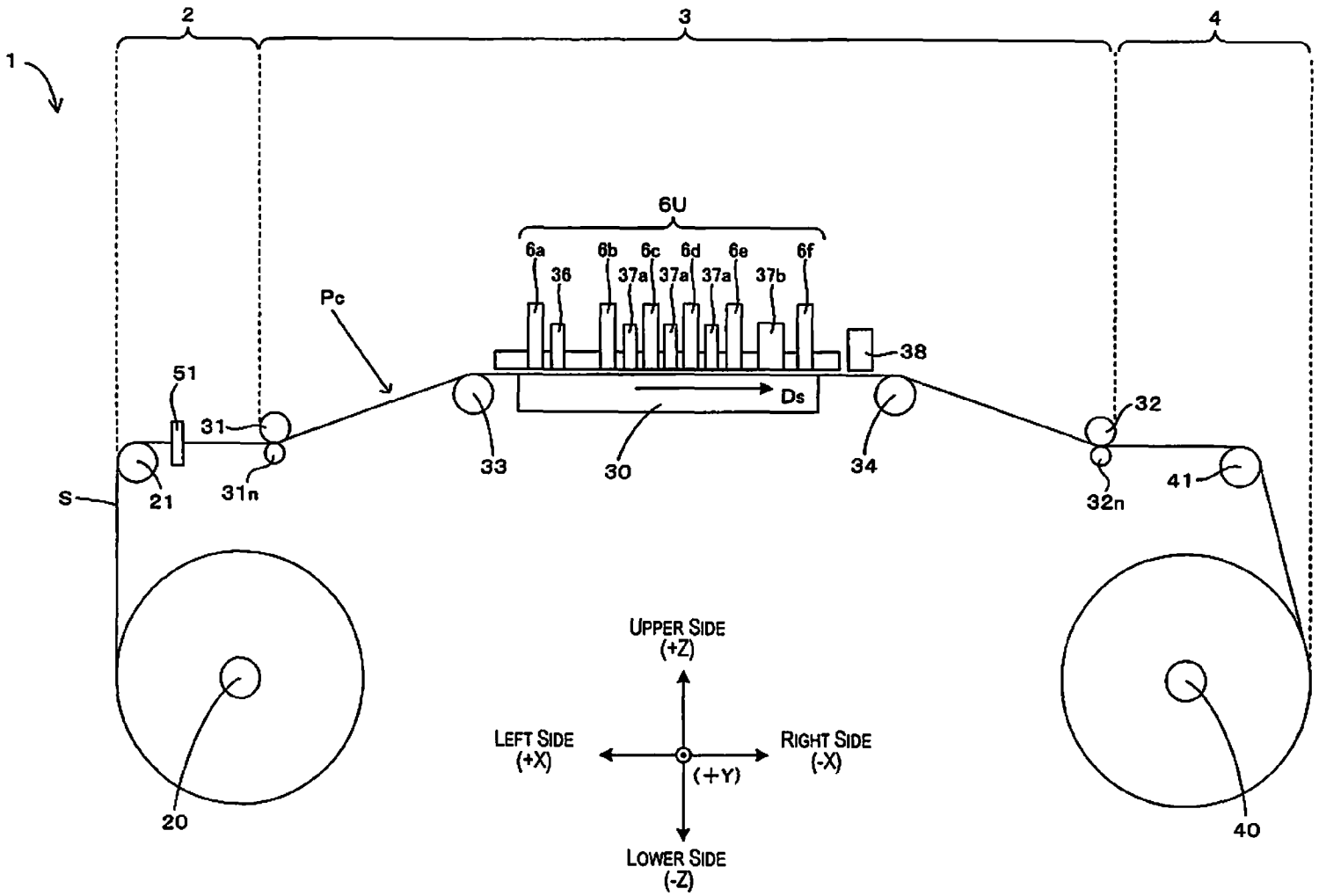
FIG. 1 is a front surface diagram schematically illustrating a configuration of a printer which is a first embodiment of a liquid ejecting apparatus according to the present invention.

FIG. 1 is a front surface diagram schematically illustrating a configuration of a printer which is a first embodiment of a liquid ejecting apparatus according to the present invention. Here, a three-dimensional coordinate system which corresponds to the left and right direction X, the front and back direction Y, and the vertical direction Z of a printer 1 is adopted in FIG. 1 and the following diagrams in order to clarify arrangement relationships of each of the sections in the printer 1 as necessary.

As shown in FIG. 1, a feeding section 2, a processing section 3, and a winding section 4 are arranged in the printer 1 in the left and right direction. The feeding section 2 and the winding section 4 respectively have a feeding out shaft 20 and a winding shaft 40. Then, both ends of a sheet S (a medium) are wound into the shape of a roll by the feeding section 2 and the winding section 4 and are stretched between the feeding section 2 and the winding section 4. After the sheet S is transported from the feeding shaft 20 to the processing section 3 along a transport path Pc which stretches out in this manner and undergoes an image recording process using a printing unit 6U, the sheet S is transported to the winding shaft 40. It is possible for the classification of the sheets S to be divided into paper and film. Here, in the following description, out of both surfaces of the sheet S, the surface on which an image is recorded is the front surface and the surface on the opposite side is the rear surface.

The feeding section 2 has the feeding shaft 20 around which an edge of the sheet S is wound and a driven roller 21 which winds in the sheet S which is drawn out from the feeding shaft 20. The sheet S which is wound around the feeding shaft 20 is fed out to the processing section 3 through the driven roller 21 by the feeding shaft 20 being rotated.

The processing section 3 records an image on the sheet S using the printing unit 6U while supporting the sheet S, which is fed out from the feeding section 2, on a platen 30. In other words, the printing unit 6U has a plurality of heads 6*a* to 6*f* which line up along the front surface of the platen 30 and an image is recorded on the sheet S by the heads 6*a* to 6*f* ejecting ink onto the sheet S which is supported by the front surface of the platen 30. In the processing section 3, a front driving roller 31 and a rear driving roller 32 are provided on both sides of the platen 30 and the sheet S which is transported from the front driving roller 31 to the rear driving roller 32 is supported by the platen 30 and undergoes image printing.

Driven rollers 33 and 34 are provided on both sides on the left and right of the platen 30, and the driven rollers 33 and 34 wind in the sheet S, which is transported from the front driving roller 31 to the rear driving roller 32, from the rear surface side.

A nip roller 31*n* is provided with regard to the front driving roller 31. It is possible to perform reliable transporting of the sheet S using the front driving roller 31 by inserting the sheet S between the front driving roller 31 and the nip roller 31*n*.

In the same manner, a nip roller 32*n* is provided with regard to the rear driving roller 32.

In this manner, the sheet S which is transported from the front driving roller 31 to the rear driving roller 32 is transported in the transport direction Ds on the platen 30 while being supported by the platen 30. Then, in the processing section 3, the plurality of heads 6*a* to 6*f*, which eject ink using an ink jet system with regard to the front surface of the sheet S which is supported by the platen 30, line up in the transport direction Ds while facing the front surface of the platen 30. Nozzle rows are formed in each of the heads 6*a* to 6*f* by a plurality of nozzles being lined up in the form of a straight line in the Y direction which is orthogonal to the transport direction Ds and the nozzle rows are lined up in a plurality of rows to be spaced at intervals in the transport direction Ds. Accordingly, it is possible for each of the heads 6*a* to 6*f* to record a line image with a plurality of lines at the same time. Then, the heads 6*a* to 6*f* eject inks of corresponding colors using an ink jet system while facing the front surface of the sheet S which is supported by the platen 30 and being spaced with a slight clearance.

The heads 6*b* to 6*e* out of these heads form color images by respectively ejecting inks of yellow (Y), cyan (C), magenta (M), and black (K). In addition, the head 6*a* which is installed on the upstream side of the head 6*b* in the transport direction Ds (the left hand side in FIG. 1) ejects white (W) ink and prints a background (referred to below as a "background image") for the color images which are formed by the heads 6*b* to 6*e*. Furthermore, the head 6*f* which is installed on the downstream side of the head 6*e* in the transport direction Ds (the right hand side in FIG. 1) ejects transparent ink and the transparent ink is further ejected with regard to the color images and the background image.

In relation to this, ultraviolet (UV) ink (photocurable ink) which is cured by irradiating ultraviolet rays (light) is used as the ink. Therefore, the present embodiment is provided with a UV lamp 36 for the background image, UV lamps 37*a* and 37*b* for the color images, and a UV lamp 38 for the transparent ink. That is, the UV lamps 36, 37*a*, 37*b*, and 38 fix each of the inks to the sheet S by curing the inks.

In this manner, for example, color images with a background image which is coated by transparent ink are formed by appropriately executing ejecting and curing of ink with regard to the sheet S which is supported by the platen 30 in the processing section 3. Then, the sheet S where the color images are formed is transported to the winding section 4 by the rear driving roller 32.

The winding section 4 has the winding shaft 40 around which an end of the sheet S is wound and a driven roller 41 which winds in the sheet S which is transported to the winding shaft 40. The sheet S is wound around the winding shaft 40 through the driven roller 41 by the winding shaft 40 being rotated.

Figure 2:
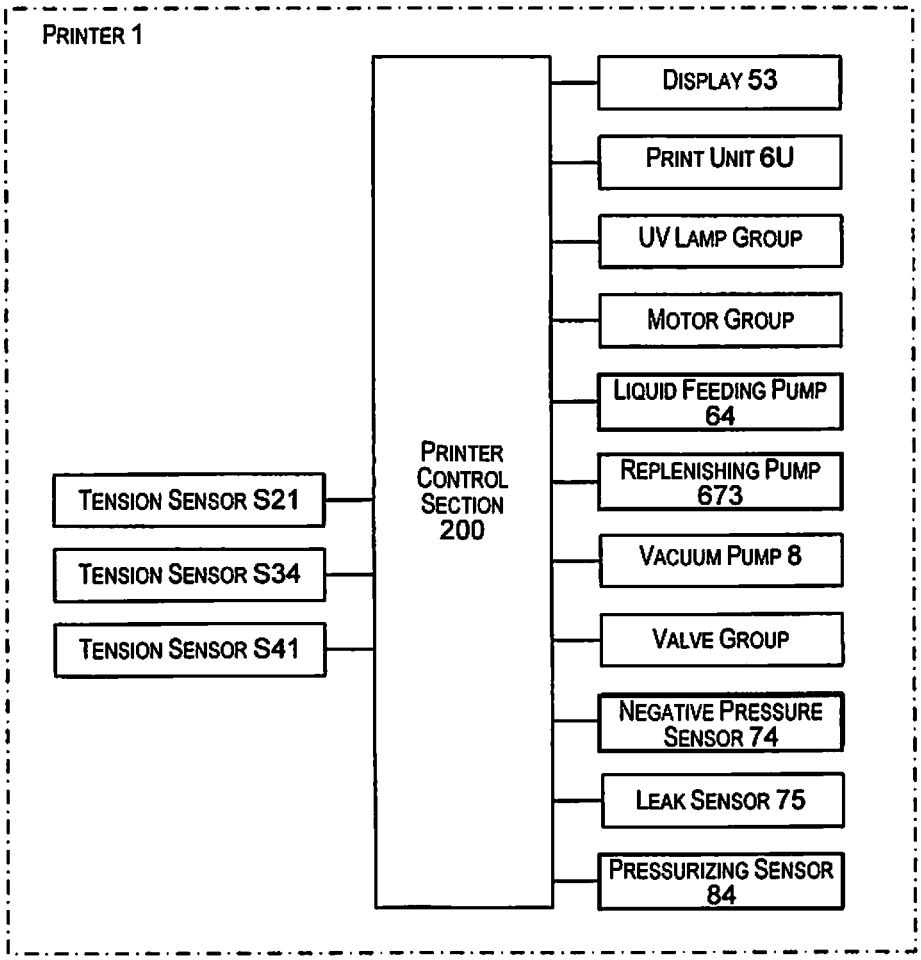
FIG. 2 is a block diagram schematically illustrating an electrical configuration which controls the printer shown in FIG. 1.

The above is a summary of the mechanical configuration of the printer 1. Next, the electrical configuration which controls the printer 1 will be described. FIG. 2 is a block diagram schematically illustrating an electrical configuration which controls the printer shown in FIG. 1. The printer 1 is provided with a printer control section 200 which controls each of the sections of the printer 1 according to instructions from an external host computer or the like. Then, the heads, the UV lamps, and each of the sections of the apparatus in the sheet transporting system and the ink supply system are controlled by the printer control section 200. The details of controlling the printer control section 200 with regard to each of the sections of the apparatus are as follows.

The printer control section 200 governs the functions which control transporting of the sheet S which was described in detail using FIG. 1. In other words, out of the members which configure the sheet transporting system, motors are respectively connected with the feeding shaft 20, the front driving roller 31, the rear driving roller 32, and the winding shaft 40. Then, the printer control section 200 controls transporting of the sheet S by controlling the speed and torque of each of the motors while rotating the group of motors.

Furthermore, the printer control section 200 controls the operation of the heads 6*a* to 6*f* of the printing unit 6U and the operation of the UV lamps 36, 37*a*, 37*b*, and 38 according to the transport status of the sheet S on the platen 30.

In addition, the printer 1 is provided with a display 53 as a user interface. The display 53 is configured by a touch panel and also fulfils an input function where input from a user is received in addition to a display function where display is performed with regard to the user. Then, the printer control section 200 displays various types of information and instructions on the display 53 and controls each of the sections of the printer 1 in accordance with input from the user.

The above is an outline of the electrical configuration of the printer 1. Here, the printing unit 6U in the printer 1 according to the embodiment is equipped with degassing units with regard to the ink supply mechanism in order to remove bubbles from the inks which are used in the printing heads 6*a* to 6*f*. Then, the degassing process is executed by the printer control section 200 controlling each of the sections of the ink supply mechanism. In addition, although omitted from the description above, a maintenance unit is provided which performs maintenance with regard to the nozzles of the printing head 6. Then, a pressurizing cleaning process is executed as one type of maintenance described above by the printer control section 200 controlling each of the sections of the ink supply mechanism. In particular, the degassing process and the pressurizing cleaning process are executed using a single pump in the present embodiment. Therefore, the configuration of the printing heads 6*a* to 6*f* will be described below and the configuration and operation of the ink supply mechanism which supplies ink to the printing heads 6*a* to 6*f* will be described below. Here, in a case of referring to any one printing head of the printing heads 6*a* to 6*f* without distinguishing between the printing heads 6*a* to 6*f*, the printing head 6 refers to any of these printing heads and the ink supply mechanism will be described based on the printing head 6.

Figure 3:
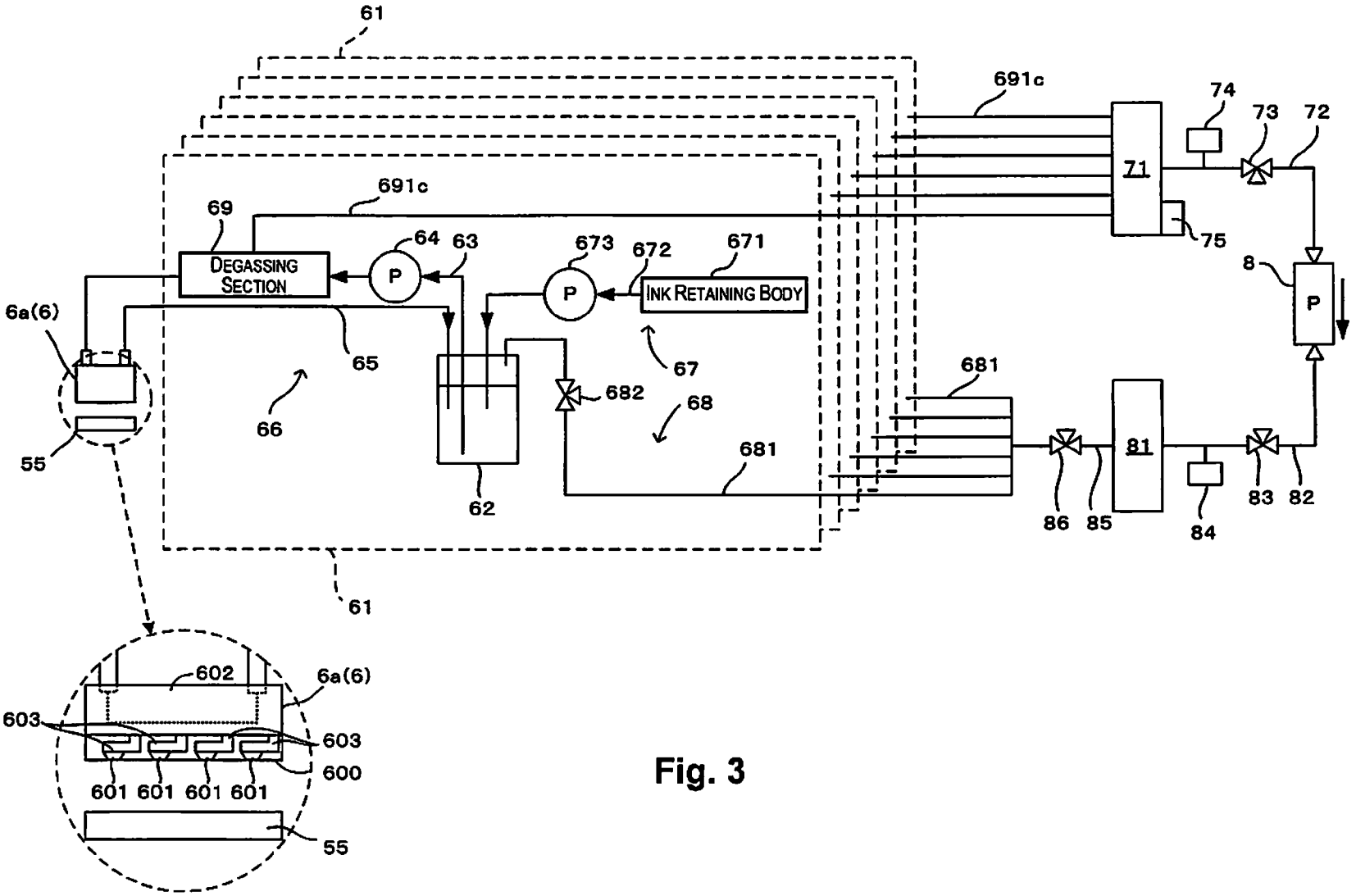
FIG. 3 is a diagram schematically illustrating an example of a configuration of a head and an ink supply mechanism.
Figure 4:
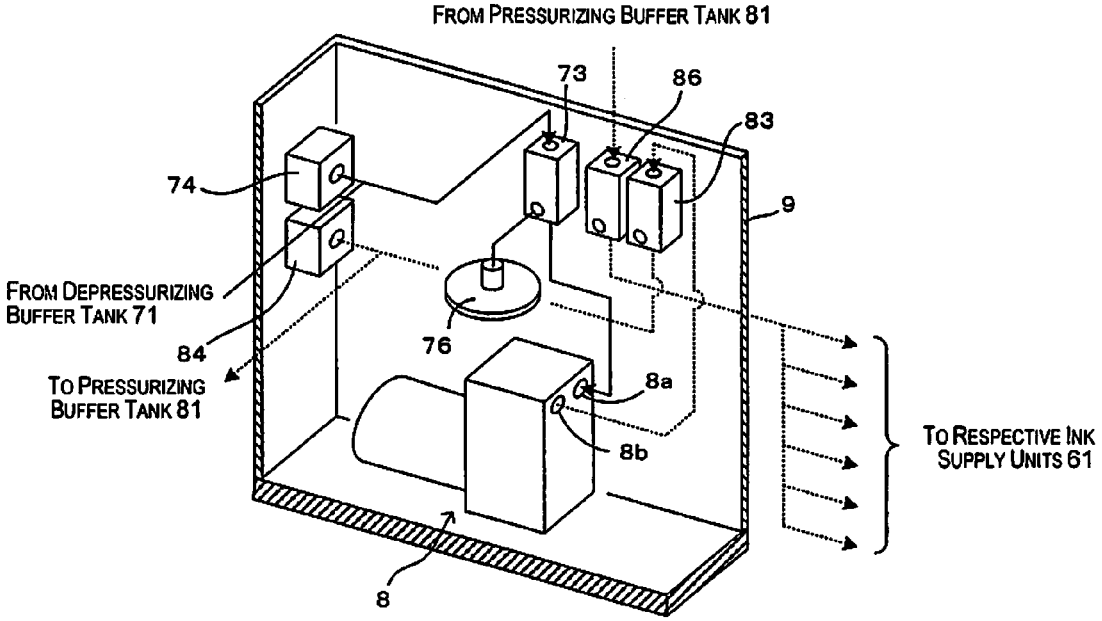
FIG. 4 is a partial perspective diagram illustrating a portion of the ink supply mechanism.

FIG. 3 is a diagram schematically illustrating an example of a configuration of the head and the ink supply mechanism. In addition, FIG. 4 is a partial perspective diagram illustrating a portion of the ink supply mechanism. The printing head 6 has nozzles 601 which are openings in a nozzle forming surface 600, a reservoir 602 which temporarily retains ink, and cavities 603 which communicate between the nozzles 601 and the reservoir 602, and ink is supplied from the reservoir 602 to the nozzles 601 via the cavities 603. Then, ink is ejected from the nozzles 601 by a pressure being applied to the ink in the cavities 603 according to operation instructions from the printer control section 200 (FIG. 2).

The reference numeral 55 in the drawing indicates the maintenance unit which performs maintenance with regard to the nozzles 601 of the printing head 6. The maintenance unit 55 is provided to be adjacent to the platen 30 in the Y direction. Then, each of the printing heads 6 moves freely in the Y direction between above the platen 30 and above the maintenance unit 55, and the printing heads 6 are positioned above the platen 30 during the printing operation and the printing heads 6 are positioned above the maintenance unit 55 during maintenance. Here, detailed description of the maintenance unit 55 will be omitted since the maintenance unit which is described in, for example, Japanese Unexamined Patent Application Publication No. 2012-086409 and the like, are known.

Ink supply sections 61 are provided for each of the printing heads 6*a* to 6*f* in the ink supply mechanism and control the supply of ink according to operation instructions from the printer control section 200. The ink supply sections 61 have the same basic configurations and differ only in the number of degassing units as will be described later. That is, the ink supply section 61 (which is equivalent to the "supply section" in the present invention) has a tank 62 (which is equivalent to the "retaining section" of the present invention) which retains ink, a supply flow path 63 (a supply tube) which connects the tank 62 and the reservoir 602 of the printing head 6, a liquid feeding pump 64 which is provided in the supply flow path 63, and a recovery flow path 65 (a recovery tube) which connects the reservoir 602 of the printing head 6 and the tank 62. In this manner, a circulation path 66 is formed so that the ink flows in order of the tank 62, the supply flow path 63, the reservoir 602 of the printing head 6, the recovery flow path 65, and the tank 62. As a result, the ink circulates in the circulation path 66 due to the liquid feeding pump 64 rotating in the forward direction according to rotation instructions from the printer control section 200. That is, the ink which is retained in the tank 62 is supplied to the printing head 6 via the supply flow path 63 (outgoing path) using the liquid feeding pump 64 and is recovered from the printing head 6 to the tank 62 via the recovery flow path 65 (return path).

In addition, the ink supply section 61 has an ink replenishing mechanism 67 which performs replenishing of ink into the tank 62 and a pressure adjusting mechanism 68 which adjusts the pressure inside the tank 62. The ink replenishing mechanism 67 has an ink retaining body 671 which is able to be replaced or refilled such as an ink cartridge or an ink pack, a replenishing flow path 672 (a replenishing tube) which connects the ink retaining body 671 and the tank 62, and a replenishing pump 673 which is provided in the replenishing flow path 672. Then, the ink inside the ink retaining body 671 is replenished into the tank 62 via the replenishing flow path 672 by the replenishing pump 673 rotating in the forward direction according to replenishing instructions from the printer control section 200.

In addition, the pressure adjusting mechanism 68 has a pressurizing path (pressurizing piping) 681, which connects a pressurizing buffer tank which will be described later and the tank 62, and a three way valve 682 which is provided in the pressurizing path 681. Then, the pressure inside the tank 62 is adjusted by the three way valve 682 being operated according to valve switching instructions from the printer control section 200. That is, the three way valve 682 has a function of switching between a path from a pressurizing buffer tank which will be described later to the tank 62 and a path which introduces outside air into the tank 62, and the three way valve 682 is able to select each of the paths according to switching instructions from the printer control section 200. When, for example, switching to the path from the pressurizing buffer tank to the tank 62, the positive pressure which is collected in the pressurizing buffer tank is applied to the tank 62 and the pressure inside the tank 62 increases. In contrast to this, when switching to the path which introduces outside air into the tank 62, the inside of the tank 62 is opened to the outside air and returns to atmospheric pressure.

Furthermore, a degassing section 69 is provided in the present embodiment for removing gaseous components such as bubbles which are included in the ink. That is, the degassing section 69 is provided along with the liquid feeding pump 64 in the supply flow path 63 on the downstream side with regard to the liquid feeding pump 64 in the ink supply direction and degasses the ink which is supplied to the printing head 6 using degassing units (which are not shown in the diagram).

Here, the degassing sections 69 for each of the inks may have the same configuration in a case where gaseous components are included to the same degree in all of the inks, but it is desirable that the degassing capacities be different, in a case where the amounts of the gaseous components are different, according to the types (color, composition, and the like) of the inks. In the present embodiment, the degassing capacity is increased in order to use white ink for forming the background image by the number of degassing units being higher than the other degassing sections 69 in the degassing section 69 for white ink. This is because white ink includes a substance with high sedimentation compared with other inks and includes more bubbles than the other inks as a result of undergoing sufficient stirring beforehand. Due to such a technical background, for example, four degassing units are used in the degassing sections 69 other than for white ink in the present embodiment, while, for example, six degassing units are used only in the degassing section 69 for white ink. Here, the degassing units are configured such that, for example, a plurality of gas permeable membranes are arranged in an interior space of a vacuum chamber and UV ink flows inside the gas permeable membranes, and it is possible to use degassing units which are configured so as to supply negative pressure to the vacuum chamber. It is obvious that the configuration of the degassing units is not limited to this and it is possible to use any units as the degassing units as long as it is possible to degas UV ink using negative pressure in the depressurizing buffer tank which will be described later.

Each of the degassing sections 69 is connected with a depressurizing buffer tank 71 via a negative pressure supply path 691*c* as shown in FIG. 3. The depressurizing buffer tank 71 has, for example, a cylindrical shape and it is possible to collect negative pressure in the interior space thereof. The depressurizing buffer tank 71 is connected with a vacuum pump 8 through a negative pressure introduction path (piping) 72. In addition, a three way valve 73 is provided in the negative pressure introduction path 72. The three way valve 73 has a function of switching between the path from the depressurizing buffer tank 71 to the vacuum pump 8 and the path which introduces outside air into the vacuum pump 8, and the three way valve 73 is able to select each of the paths according to switching instructions from the printer control section 200. When, for example, switching to the path from the depressurizing buffer tank 71 to the vacuum pump 8, pressure in the interior space in the depressurizing buffer tank 71 is reduced by depressurizing using the vacuum pump 8. Negative pressure is accumulated in the depressurizing buffer tank 71 by continuing driving of the vacuum pump 8 and continuing the depressurizing, and the negative pressure which is accumulated is collected. On the other hand, when switching to the path which introduces outside air into the vacuum pump 8, depressurizing of the depressurizing buffer tank 71 due to the vacuum pump 8 is stopped. Here, a negative pressure sensor 74 is provided in order to measure the pressure inside the depressurizing buffer tank 71. In addition, a leak sensor 75 is installed to oppose a lower part of the side surface of the depressurizing buffer tank 71 and it is possible to detect ink leaks using the leak sensor 75 when ink flows into the interior space of the depressurizing buffer tank 71.

In addition, a pressurizing buffer tank 81 is provided in addition to the depressurizing buffer tank 71 in the present embodiment. The pressurizing buffer tank 81 has the same structure as the depressurizing buffer tank 71 and it is possible to collect positive pressure in the interior space thereof. In other words, the pressurizing buffer tank 81 is connected with the vacuum pump 8 using a pressurizing introduction path (piping) 82. In addition, a three way valve 83 is provided in the pressurizing introduction path 82. The three way valve 83 has a function of switching between the path from the vacuum pump 8 to the pressurizing buffer tank 81 and the path where air is released from the vacuum pump 8 to the outside air, and the three way valve 83 is able to select each of the paths according to switching instructions from the printer control section 200. When, for example, switching to the path from the vacuum pump 8 to the pressurizing buffer tank 81, pressurizing is carried out using the vacuum pump 8 and the pressure in the interior space of the pressurizing buffer tank 81 increases. Positive pressure is accumulated in the pressurizing buffer tank 81 by continuing driving of the vacuum pump 8 and continuing the pressurizing, and the positive pressure which is accumulated is collected. On the other hand, when switching to the path where air is released from the vacuum pump 8 to the outside air, pressurizing of the pressurizing buffer tank 81 using the vacuum pump 8 is stopped. Here, a pressurizing sensor 84 is provided in order to measure the pressure inside the pressurizing buffer tank 81.

In addition, one end of a common pressurizing path (piping) 85 is connected with the pressurizing buffer tank 81. The other end of the common pressurizing path 85 is branched into six paths and each of the branched paths functions as the pressurizing path 681. Furthermore, a three way valve 86 is provided in the common pressurizing path 85 and has a function of switching between the path from the pressurizing buffer tank 81 to each of the ink supply sections 61 and the path where pressurization is released from the pressurizing buffer tank 81 to the outside air, and the three way valve 86 is able to select each of the paths according to switching instructions from the printer control section 200. When, for example, switching to the path from the pressurizing buffer tank 81 to each of the ink supply sections 61, each of the sections of the ink supply sections 61 is pressurized using the positive pressure inside the pressurizing buffer tank 81. On the other hand, when switching to the path where air is released from the pressurizing buffer tank 81 to the outside air, supplying of pressurization to each of the ink supply sections 61 using the positive pressure inside the pressurizing buffer tank 81 is stopped.

Here, an accommodating box (an accommodating section) 9 is provided in the present embodiment as shown in FIG. 4. Then, the vacuum pump 8, components (the negative pressure introduction path 72, the three way valve 73, and the negative pressure sensor 74) on the vacuum pump 8 side with regard to the depressurizing buffer tank 71, and components (the pressurizing introduction path 82, the three way valve 83, and the pressurizing sensor 84) on the vacuum pump 8 side with regard to the pressurizing buffer tank 81 are collectively accommodated in an inner section of the accommodating box 9, and it is possible to achieve a reduction in the size of the apparatus. The reference numeral 76 in the drawing is a filter.

In the printer 1 which is configured in the above manner, the printing head 6 is positioned above the platen 30 during the printing operation. Then, ink inside the tank 62 is supplied to the printing head 6 in this state by the printer control section 200 controlling each of the sections of the apparatus, and forming of the background image, forming of the color image, and coating using the transparent ink are executed.

Figure 5:
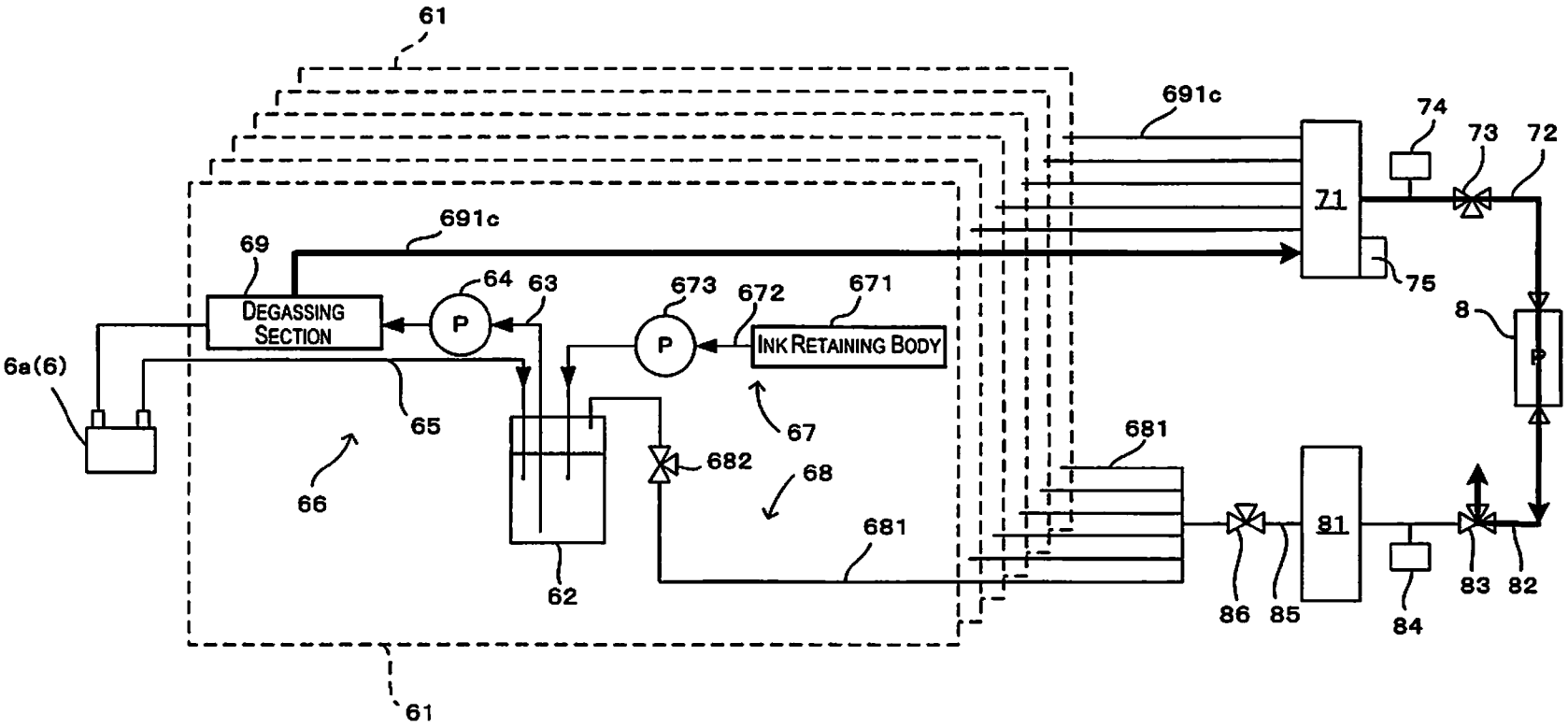
FIG. 5 is a diagram schematically illustrating a degassing operation in the printer of FIG. 1.

In addition, the degassing sections 69 are connected with the depressurizing buffer tank 71 via the negative pressure supply path 691*c* and a degassing process is executed by each of the degassing units being depressurized using the negative pressure inside the depressurizing buffer tank 71. In order to maintain a set pressure (negative pressure) inside the depressurizing buffer tank 71, the printer control section 200 controls each of the sections of the apparatus as shown in FIG. 5 based on the detection result of the negative pressure sensor 74. That is, in the three way valve 73 which is interposed in the negative pressure introduction path 72, a port which is connected with an intake port 8*a* (refer to FIG. 4) of the vacuum pump 8 is a common port, and whereas the port which is linked to the outside air out of the remaining ports (referred to below as a "negative pressure side outside air opening port") is normally open, the port which is connected with the depressurizing buffer tank 71 (referred to below as a "negative pressure side opening and closing port") is normally closed. In addition, in the three way valve 83 which is interposed in the pressurizing introduction path 82, a port which is connected with a discharge opening 8*b* (refer to FIG. 4) of the vacuum pump 8 is a common port, and whereas the port which is linked to the outside air out of the remaining ports (referred to below as a "positive pressure side outside air opening port") is normally open, the port which is connected with the pressurizing buffer tank 81 (referred to below as a "positive pressure side opening and closing port") is normally closed. Accordingly, a path where outside air is introduced to the vacuum pump 8 is normally opened in a state where the path from the depressurizing buffer tank 71 to the vacuum pump 8 is blocked and the intake port 8*a* of the vacuum pump 8 is opened to the outside air.

As a result, the pressure value of the depressurizing buffer tank 71 in the normal state is gradually increased by executing the degassing process. Then, when the detection result of the negative pressure sensor 74 reaches a set value, the printer control section 200 depressurizes the depressurizing buffer tank 71 by closing the negative pressure side outside air opening port of the three way valve 73 and opening the negative pressure side opening and closing port after operating the vacuum pump 8 as shown in FIG. 5. Here, air from the discharge opening 8*b* of the vacuum pump 8 is released to the outside air at this time via the positive pressure side outside air opening port.

When the pressure value of the depressurizing buffer tank 71 finally decreases below the set value, the printer control section 200 stops the vacuum pump 8 and further respectively opens and closes the negative pressure side outside air opening port and the negative pressure side opening and closing port. Due to this, returning to the normal state, the degassing process in the degassing sections 69 is executed by depressurizing using the negative pressure inside the depressurizing buffer tank 71.

In this manner, negative pressure is accumulated in the depressurizing buffer tank 71 in the present embodiment by carrying out depressurizing using the vacuum pump 8 and the degassing process is performed by carrying out depressurizing using the negative pressure inside the depressurizing buffer tank 71. As a result, it is not necessary to always operate the vacuum pump 8 and it is also possible to avoid the effects of variation in pressure in the vacuum pump 8. As a result, it is possible to favorably and stably perform the degassing process.

Figure 6:
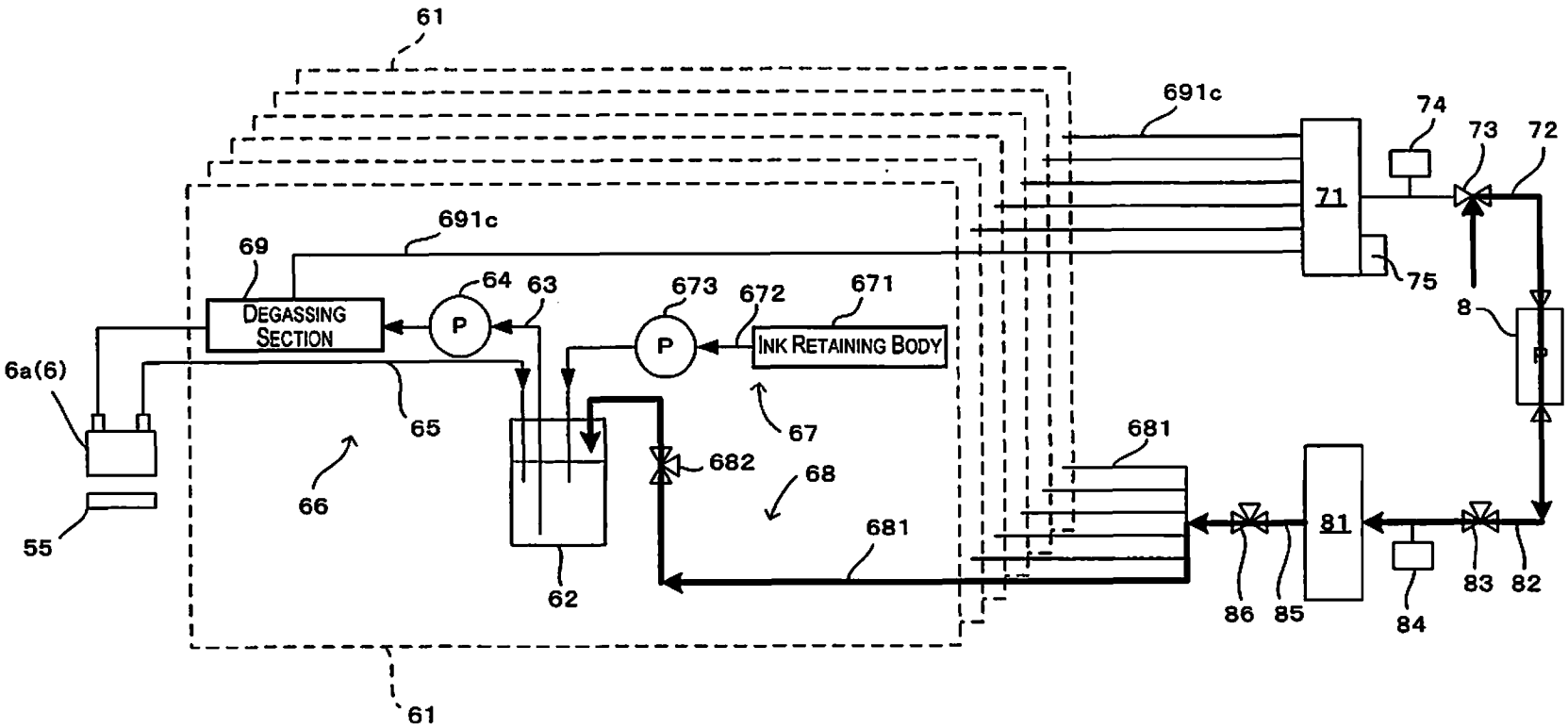
FIG. 6 is a diagram schematically illustrating a pressurizing cleaning operation in the printer of FIG. 1.

In addition, in a case where there is an instruction from the user via the display 53, when the power is turned on, or the like, a pressurizing cleaning process is executed as one type of maintenance as described below by the printer control section 200 controlling each of the sections of the apparatus. The printing head 6 is positioned above the maintenance unit 55 during maintenance as shown in FIG. 6. Then, rotation speed of the liquid feeding pump 64 accelerates in the forward direction up to a set pressurizing speed. In addition, the pressurizing speed is a speed which is faster than the normal speed during the printing operation. Then, the maintenance unit 55 performs capping of the nozzle forming surface 600 and the pressure adjusting mechanism 68 pressurizes the tank 62 to a positive pressure. In more detail, the pressurizing cleaning process is executed in the following manner.

The three way valve 86 is interposed as described above in the common pressurizing path 85 which connects the pressure adjusting mechanism 68 and the pressurizing buffer tank 81. In the three way valve 86, a port which is connected with the pressurizing buffer tank 81 is a common port, and whereas the port which is linked with the outside air out of the remaining ports is normally closed, the port which is connected with the three way valve 682 of the pressure adjusting mechanism 68 is normally open. The three way valve 86 is maintained in the normal state during the pressurizing cleaning and positive pressure is supplied from the pressurizing buffer tank 81 to the three way valve 682 of the pressure adjusting mechanism 68.

In the three way valve 682 of the pressure adjusting mechanism 68, a port which is connected with the tank 62 is a common port, and whereas the port which is linked with the outside air out of the remaining ports is normally open, the port which is connected with the three way valve 86 is normally closed. Then, the atmosphere opening port is closed during the pressurizing cleaning and the tank 62 is pressurized using the positive pressure inside the pressurizing buffer tank 81 by opening the port which is connected with the three way valve 682 of the pressure adjusting mechanism 68.

In this manner, when the tank 62 is pressurized using the positive pressure inside the pressurizing buffer tank 81, the pressure in the pressurizing buffer tank 81 decreases. Here, when the pressure decreases to be the set value or less, it is difficult to continue the pressurizing cleaning. Therefore, when the pressurizing sensor 84 detects a decrease in pressure, the printer control section 200 closes the positive pressure side outside air opening port of the three way valve 83 after operating the vacuum pump 8 and pressurizes the pressurizing buffer tank 81 by opening the positive pressure side opening and closing port in the present embodiment as shown in FIG. 6. Here, the intake port 8*a* side of the vacuum pump 8 is opened to the outside air at this time. When the pressure value inside the pressurizing buffer tank 81 finally decreases below the set value, the printer control section 200 stops the vacuum pump 8 and further respectively opens and closes the positive pressure side outside air opening port and the positive pressure side opening and closing port.

In this manner, the interior pressure of the pressurizing buffer tank 81 is always preserved at the set value or more and pressurizing of the tank 62 is performed using the positive pressure inside the pressurizing buffer tank 81. Due to this, the nozzles 601 are pressurized from the tank 62 via the recovery flow path 65. By removing the capping after the pressurizing, the ink inside the nozzles 601 is discharged onto the maintenance unit 55. In addition, bubbles or the like in the nozzles 601 are discharged from the nozzles 601 along with the ink which is discharged from the nozzles 601.

Following the discharging, wiping is executed with regard to the nozzle forming surface 600. Due to this, ink which is attached to the nozzle forming surface 600 due to being discharged from the nozzles 601 is wiped away. Next, the rotation speed (circulation speed) of the liquid feeding pump 64 decreases to the normal speed and all of the nozzles 601 are filled with ink by executing flushing. In this manner, when the flushing is complete, the pressurizing cleaning is finished.

In this manner, for the pressurizing as well as the depressurizing in the present embodiment, positive pressure is accumulated in the pressurizing buffer tank 81 by carrying out pressurizing using the vacuum pump 8 and the pressurizing cleaning process is performed using the positive pressure inside the pressurizing buffer tank 81. As a result, it is not necessary to always operate the vacuum pump 8 and it is also possible to avoid the effects of variation in pressure in the vacuum pump 8. As a result, it is possible to favorably and stably perform the pressurizing cleaning process.

As described above, it is possible to execute the degassing process described above and the pressurizing cleaning process by pressurizing the nozzles 601 of the printing head 6 using the single vacuum pump 8 according to the present embodiment. Accordingly, it is possible to reduce the size of the printer 1 which executes the degassing process and the pressurizing cleaning process and it is possible to suppress costs for the apparatus.

In addition, positive pressure is accumulated in the pressurizing buffer tank 81 by carrying out pressurizing using the vacuum pump 8 and the tank 62 is pressurized using the positive pressure inside the pressurizing buffer tank 81 at an appropriate timing. In this manner, it is possible to apply necessary positive pressure to the ink at a necessary timing using buffering of the positive pressure and it is possible to favorably and stably perform the pressurizing cleaning process. Furthermore, the pressurizing and stopping pressurizing of the pressurizing buffer tank 81 are performed using the three way valve 83 based on the detection result of the pressurizing sensor 84. As a result, it is possible to accurately control the internal pressure of the pressurizing buffer tank 81. Accordingly, it is possible to pressurize the ink to an appropriate value and it is possible to favorably perform the pressurizing cleaning process.

In addition, the depressurizing is the same as the pressurizing such that negative pressure is accumulated in the depressurizing buffer tank 71 by carrying out depressurizing using the vacuum pump 8 and degassing of the ink is performed using the negative pressure inside the depressurizing buffer tank 71. In this manner, due to buffering of the negative pressure, it is not necessary to always operate the vacuum pump 8 in order to perform the degassing process, and it is possible to suppress variation in the depressurizing in the degassing sections 69. Accordingly, it is possible to favorably and stably perform the degassing process. Furthermore, the depressurizing and stopping depressurizing of the depressurizing buffer tank 71 using the vacuum pump 8 are performed using the three way valve 73 based on the detection result of the negative pressure sensor 74. As a result, it is possible to accurately control the internal pressure of the depressurizing buffer tank 71. Accordingly, it is possible to depressurize the ink to an appropriate value and it is possible to favorably perform the degassing process.

<Second Embodiment>

Figure 7:
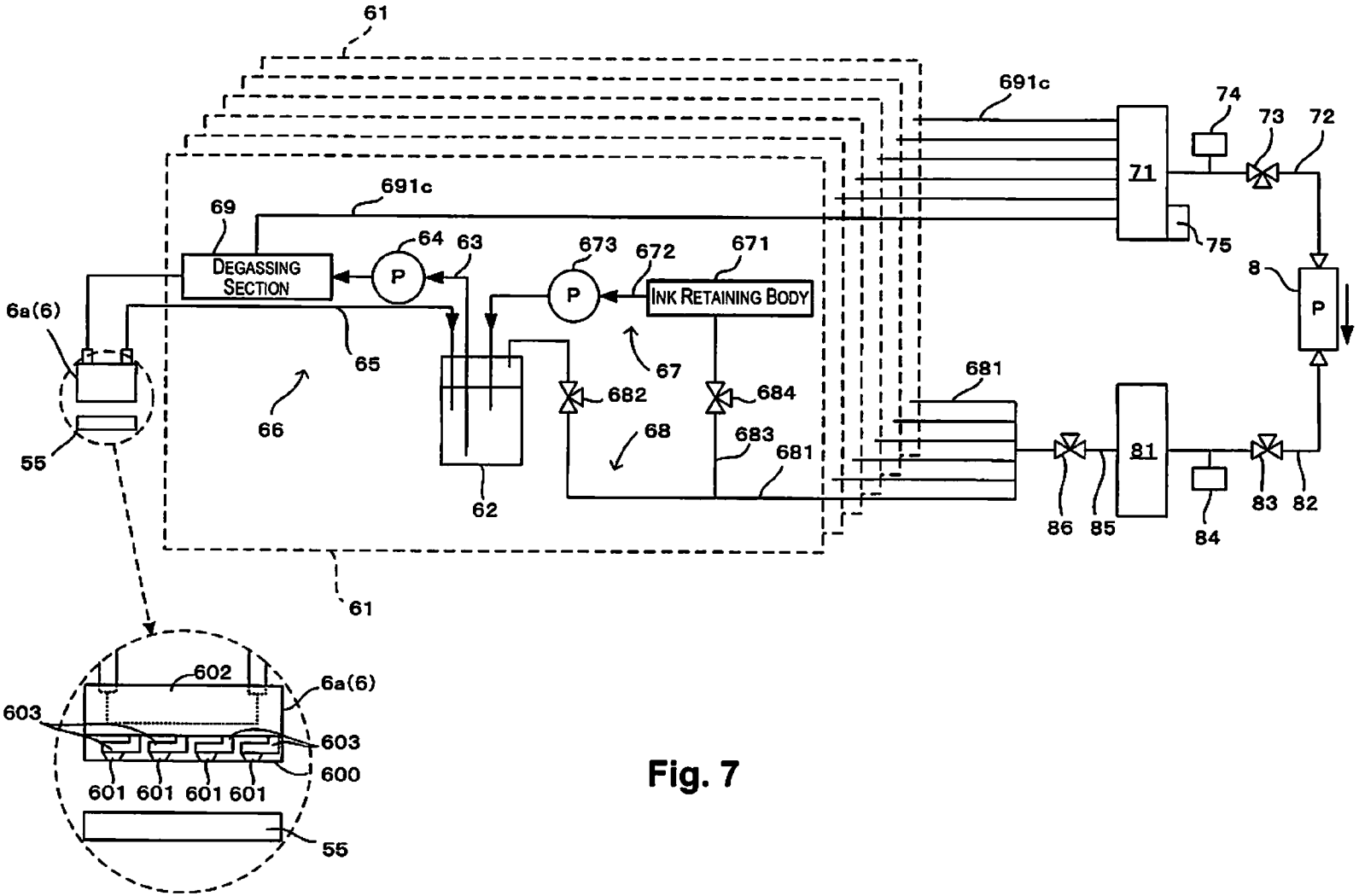
FIG. 7 is a diagram illustrating a configuration of a second embodiment of a liquid ejecting apparatus according to the present invention.
Figure 8A:
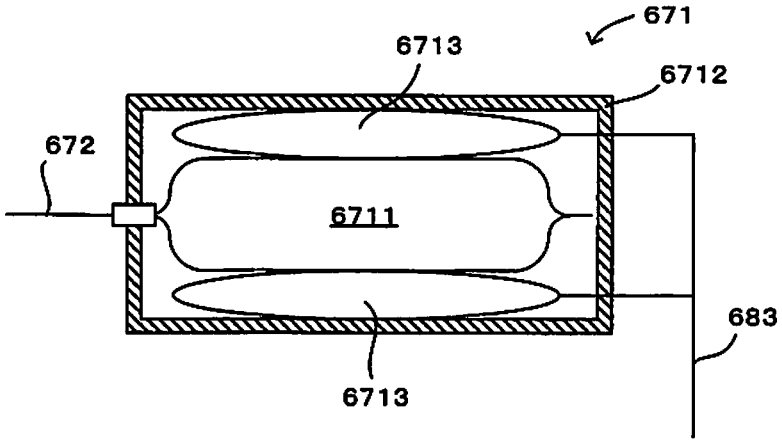
FIGS. 8A and 8B are diagrams illustrating a configuration of an ink retaining body.
Figure 8B:
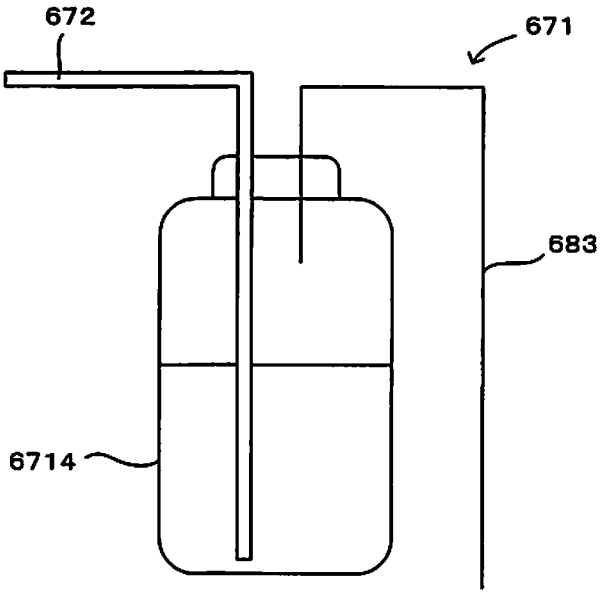

FIG. 7 is a diagram illustrating a configuration of a printer which is a second embodiment of a liquid ejecting apparatus according to the present invention. In addition, FIGS. 8A and 8B are schematic diagrams illustrating a configuration of the ink retaining body. The point whereby the second embodiment is significantly different to the first embodiment is the addition of a configuration where positive pressure is supplied to the ink retaining body 671 in the pressure adjusting mechanism 68 and the configuration of the second embodiment is the same as the configuration of the first embodiment in other respects.

The ink retaining body 671 is provided with, for example, an ink pack 6711 as shown in FIG. 8A. The ink pack 6711 is accommodated in a state of being pinched by two air bags 6713 inside a housing 6712. In addition, each of the air bags 6713 is connected with a branched pressurizing path (piping) 683 which is branched from the pressurizing path 681 and each of the air bags 6713 is able to receive a supply of positive pressure from the pressurizing buffer tank 81. A three way valve 684 is interposed in the branched pressurizing path 683. In the three way valve 684, a port which is connected with the air bags 6713 is a common port, and whereas the port which is linked with the outside air out of the remaining ports is normally open, the port which is connected with the pressurizing path 681 is normally closed. Then, pushing out of ink is performed during ink replenishment by closing the outside air opening port and opening the port which is connected with the pressurizing path 681 to pressurize and expand the air bags 6713 using the positive pressure inside the pressurizing buffer tank 81. Here, the state returns to the normal state and the air bags 6713 are opened to the outside air when ink replenishment is not being performed.

As described above, the pressure adjusting mechanism 68 in the second embodiment uses the positive pressure inside the pressurizing buffer tank 81 not only for pressurizing cleaning but also for ink replenishment. Accordingly, not only are the same actions and effects as the first embodiment obtained, but there is a separate action and effect in that it is possible to favorably perform the ink replenishment process as one aspect of the pressurizing process using the single vacuum pump 8.

Here, the ink retaining body 671 is provided with the ink pack 6711 in the second embodiment, but there may be a configuration where positive pressure is supplied from the pressurizing buffer tank 81 via the branched pressurizing path 683 even in a case where the ink retaining body 671 is provided with an ink bottle 6714 as shown in FIG. 8B.

<Third Embodiment>

Figure 9:
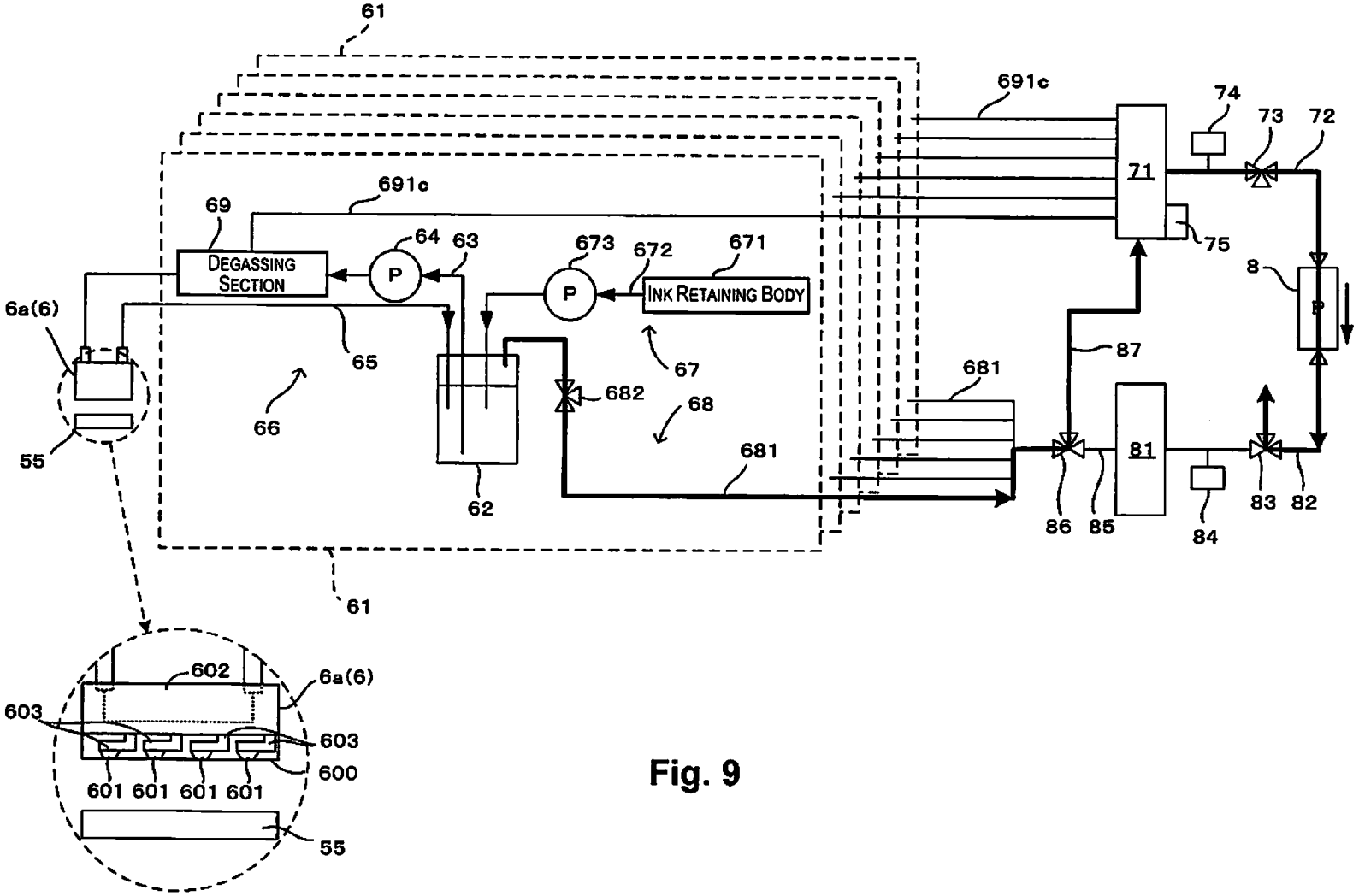
FIG. 9 is a diagram illustrating a configuration of a third embodiment of a liquid ejecting apparatus according to the present invention.

FIG. 9 is a diagram illustrating a configuration of a printer which is a third embodiment of a liquid ejecting apparatus according to the present invention. The point whereby the third embodiment is significantly different to the first embodiment is that the outside air opening port out of the ports of the three way valve 86 which is used as the outside air opening port in the first embodiment is connected with the depressurizing buffer tank 71 via a depressurizing path 87 as well as the operation of the three way valve 86, and the configuration of the third embodiment is the same as the configuration of the first embodiment in other respects.

The three ports which configure the three way valve 86 in the third embodiment are each controlled to open and close by the printer control section 200 according to the operating conditions of the printer 1. Here, in order to describe the operation, out of the three ports, the port which is connected with the depressurizing buffer tank 71 is referred to as the "depressurizing port", the port which is connected with the pressurizing buffer tank 81 is referred to as the "pressurizing port", and the port which is connected with the tank 62 which functions as the retaining section is referred to as the "retaining section port".

When performing the pressurizing cleaning process, the depressurizing port, the pressurizing port, and the retaining section port are respectively in a "state of being closed", a "state of being open", and a "state of being open", and positive pressure is supplied from the pressurizing buffer tank 81 to the tank 62.

On the other hand, when performing a suction cleaning process, the depressurizing port, the pressurizing port, and the retaining section port are respectively in a "state of being open", a "state of being closed", and a "state of being open", and the tank 62 is depressurized using negative pressure inside the depressurizing buffer tank 71 as shown in FIG. 9. That is, the inside of the tank 62 is depressurized to a negative pressure (for example, a negative pressure of −20 kPa to −70 kPa) in the suction cleaning by depressurizing the tank 62 using negative pressure in the depressurizing buffer tank 71 in a state where the supply of ink from the supply flow path 63 to the reservoir 602 is blocked. As a result, the nozzles 601 are depressurized using negative pressure inside the tank 62 and ink is suctioned from the nozzles 601. As a result, bubbles or the like, which were not able to be discharged from the nozzles 601 due to the pressurizing cleaning, flow out from the nozzles 601 along with the ink which is suctioned.

As described above, the pressure adjusting mechanism 68, the three way valve 86, and the depressurizing path 87 according to the third embodiment function as the "degassing section" of the present invention, and the degassing section uses the negative pressure inside the depressurizing buffer tank 71 not only for degassing but also for suction cleaning. Accordingly, not only are the same actions and effects as the first embodiment obtained, but there is a separate action and effect in that it is possible to favorably perform the suction cleaning using the single vacuum pump 8.

In the embodiment described above, the ink supply section 61 is equivalent to an example of the "supply section" of the present invention. In addition, the pressure adjusting mechanism 68 which is provided in the ink supply section 61 functions as a portion of the "pressurizing section" of the present invention. The three way valves 83 and 73 are respectively equivalent to examples of the "first switching section" and the "second switching section" of the present invention. The pressurizing sensor 84 and the negative pressure sensor 74 are respectively equivalent to examples of the "first pressure sensor" and the "second pressure sensor" of the present invention. In addition, the ink replenishing mechanism 67 is equivalent to an example of the "replenishment section" of the present invention.

Here, the present invention is not limited to the embodiment described above and it is possible to appropriately combine elements of the embodiment described above or to add various modifications within a scope which does not depart from the spirit of the invention. For example, it is possible to appropriately change the arrangement and number of the printing heads 6 or the UV lamps and to appropriately change the shape or the like of the platen 30.

In addition, the degassing sections 69 or the tank 62 are depressurized using the negative pressure inside the depressurizing buffer tank 71 in the embodiments described above, but there may be a configuration where depressurizing is carried out directly using the vacuum pump 8. In addition, the tank 62 and the ink retaining body 671 are pressurized using positive pressure inside the pressurizing buffer tank 81, but there may be a configuration where pressurizing is carried out directly using the vacuum pump 8.

In addition, the degassing process is performed by depressurizing the degassing units of the degassing sections 69, but the depressurizing process may be performed inside the tank 62 by depressurizing the tank 62, and in this case, the tank 62 also functions as the "degassing section" of the present invention.

In addition, it is also possible to appropriately change the specific configuration of each of the sections of the printer 1, and for example, the configuration of the printing head 6 may be changed from the configuration described above. In addition, the ink is circulated in the embodiment described above, but it is possible to apply the liquid ejecting technique according to the present invention with regard to printers where ink circulation is not performed.

The embodiment described above is adopted in ink jet printers which use UV ink, but the embodiment described above may be adopted in a liquid ejecting apparatus which ejects or discharges liquids other than UV ink. It is possible for the present invention to be applied to various types of liquid ejecting apparatuses which are provided with liquid ejecting heads or the like which discharge liquid droplets in minute amounts. Here, the liquid droplets refer to the state of the liquid which is discharged from the liquid ejecting apparatus described above and include liquid droplets which have a granular shape, a tear shape, and a trailing shape. In addition, here, it is sufficient if the liquids are material which is able to be ejected from the liquid ejecting head. For example, it is sufficient if the liquid droplets are in a state where a substance is in a liquid phase, and the substance may be a body with a fluid form such as a liquid body with high or low viscosity, a sol, a gel water, another inorganic solvent, an organic solvent, a solution, a liquid resin, or a liquid metal (a metal melt). In addition, states other than liquid as one state of matter are included where particles of a functional material formed of solid matter such as pigments and metal particles are dissolved, dispersed, or mixed into a solvent. In addition, typical examples of the liquids include inks, liquid crystals, and the like as described in the embodiments described above. Here, the inks encompass various types of liquid compositions such as typical water-based inks and oil-based inks, gel inks, hot melt inks, and ultraviolet curable inks. Specific examples of other liquid ejecting apparatuses may include liquid crystal displays, electroluminescence (EL) displays, surface-emitting displays, liquid ejecting apparatuses which eject liquids which include materials such as electrode materials or coloring materials which are used in the manufacturing or the like of color filters in a dispersed or dissolved form, liquid ejecting apparatuses which eject bio-organic material which is used in biochip manufacturing, liquid ejecting apparatuses which are used as precision pipettes and which eject liquids which are samples, textile printing apparatuses, micro dispensers, or the like. Furthermore, a liquid ejecting apparatus which ejects a lubricant in a pin point manner in precision machines such as watches or cameras, a liquid ejecting apparatus which forms minute hemispherical lenses (optical lenses) which are used in optical communication elements or the like, a liquid ejecting apparatus which ejects an etching liquid such as an acid or an alkali in order to etch a substrate or the like, and a liquid ejecting apparatus for textile printing which ejects a liquid onto a cloth or the like may be adopted. Then, it is possible to apply the present invention to any type of liquid ejecting apparatus out of these liquid ejecting apparatuses.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejecting apparatus comprising:

a head configured to eject a liquid from a nozzle;

a retaining section configured to retain the liquid;

a supply section configured to supply the liquid to the head, the supply section including a degassing section disposed between the retaining section and the head to depressurize the liquid supplied from the retaining section to the head to be less than atmospheric pressure, and a pressurizing section in which the liquid retained in the retaining section is pressurized to be more than the atmospheric pressure;

a pump having an action of depressurizing the degassing section and an action of pressurizing the pressurizing section;

a pressurizing buffer tank configured to accumulate positive pressure by being pressurized by the pump, the pressurizing section being further configured to pressurize the liquid using the pressurizing buffer tank; and a depressurizing buffer tank configured to accumulate negative pressure by being depressurized by the pump, the degassing section being further configured to execute degassing by depressurizing the liquid using the depressurizing buffer tank.

2. The liquid ejecting apparatus according to claim 1, further comprising a first switching section configured to switch between pressurizing and stopping pressurizing of the pressurizing buffer tank using the pump.

3. The liquid ejecting apparatus according to claim 1, further comprising a first pressure sensor configured to detect pressure inside the pressurizing buffer tank.

4. The liquid ejecting apparatus according to claim 1, further comprising a second switching section configured to switch between depressurizing and stopping depressurizing of the depressurizing buffer tank using the pump.

5. The liquid ejecting apparatus according to claim 1, further comprising a second pressure sensor configured to detect pressure inside the depressurizing buffer tank.

6. The liquid ejecting apparatus according to claim 1, further comprising a retaining body configured to retain the liquid, the retaining section being configured to retain the liquid between the retaining body and the head, the pressurizing section being further configured to replenish the retaining section from the retaining body by pressurizing the retaining body.

7. The liquid ejecting apparatus according to claim 1, further comprising:

a retaining body configured to retain the liquid; and a replenishing pump configured to replenish the liquid retained in the retaining body into the retaining section.

* * * * *